US005419349A

United States Patent [19]

Swain

[11] Patent Number: 5,419,349

[45] Date of Patent: May 30, 1995

[54] PORTABLE SMALL PARTS WASHER

[75] Inventor: Homer E. Swain, Dunklin County, Mo.

[73] Assignee: Emerson Electric Co., St. Louis, Mo.

[21] Appl. No.: 224,065

[22] Filed: Apr. 7, 1994

Related U.S. Application Data

[63] Continuation of Ser. No. 15,450, Feb. 9, 1993, abandoned.

[51] Int. Cl.[6] ..... B08B 3/02

[52] U.S. Cl. ..... 134/72; 15/302; 134/104.4; 134/111; 134/127; 134/131

[58] Field of Search ..... 134/68, 72, 104.4, 111, 134/127, 131; 15/302, 77, 88.1

[56] References Cited

U.S. PATENT DOCUMENTS

| | | | |
|---|---|---|---|
| 2,196,804 | 4/1940 | Ball | 134/111 X |
| 2,564,443 | 8/1951 | Palotsee | 134/104.4 X |
| 2,633,437 | 3/1953 | Detjen | 134/72 X |
| 2,698,627 | 1/1955 | Kearney et al. | 134/111 |
| 2,940,458 | 6/1960 | Speckman | 134/104.4 X |
| 3,144,872 | 8/1964 | Kearney | 134/111 X |
| 3,178,745 | 4/1965 | Kleebauer | 15/77 |
| 3,416,544 | 12/1968 | Paiva | 134/111 |
| 3,426,771 | 2/1969 | Evans et al. | 134/111 |
| 3,506,022 | 4/1970 | Nolte | 134/131 X |
| 3,922,750 | 12/1975 | Cioni et al. | 15/302 |
| 4,805,649 | 2/1989 | Nezworski | 134/111 X |
| 4,821,754 | 4/1989 | Weil | 134/111 X |

FOREIGN PATENT DOCUMENTS

| | | | |
|---|---|---|---|
| 817860 | 8/1959 | United Kingdom | 134/72 |
| 932490 | 7/1963 | United Kingdom | 134/72 |

*Primary Examiner*—Philip R. Coe
*Attorney, Agent, or Firm*—Polster, Lieder, Woodruff & Lucchesi

[57] ABSTRACT

A portable washer for extruded, cast, or molded parts includes a washer tank, a water reservoir, and a water pump which pumps the water into the tank under pressure to spray the parts with pressurized water stream or spray to remove grease, oil, or metal shavings therefrom. The washer recycles and filters the water which is used to clean the parts and need not be connected to a drain or a source of water. The washer is also provided with a drier to dry the parts after they are washed.

8 Claims, 3 Drawing Sheets

PORTABLE SMALL PARTS WASHER

This is a continuation of application Ser. No. 08/015,450, filed Feb. 9, 1993, now abandoned.

BACKGROUND OF THE INVENTION

This invention relates to industrial washers, and in particular, to a portable washer used to clean small parts.

In the production line of a product part (a motor end cap for example), the part may have oils, grease, metal shavings, etc. thereon. The part (the end cap) must therefore be cleaned before the part may be placed on its product (the motor). Typically, a plant will have a washing station where all the product parts are sent for washing. Such a station requires that all the piece parts be transported to this station for washing and then transferred to the appropriate place in the production line for assembly of the final product. Such a washing process also requires a large inventory of piece parts at each production station so that the product may be produced while new piece parts therefore are being made and washed. The use of a single washing station requires a large work-in-progress inventory so that production of the final product is not halted due to a lack of cleaned parts.

A great emphasis has been placed on the reduction of work-in-progress inventory. One method of reducing the work-in-progress inventory is to reduce the amount of transportation needed for each piece or part of the product. Thus, if the parts were washed in-line, right after production, rather than at a large washing station, the work-in-progress inventory can be reduced.

SUMMARY OF THE INVENTION

One objective of this invention, therefore, is to provide a small washer which may be used to clean parts as they are produced.

Another object is to provide such a washer which is portable.

A third object is to provide such a washer which is simple to operate and economical to produce.

These and other objects will become apparent to those skilled in the art upon a review of the following disclosure and accompanying drawings.

In accordance with the invention, briefly stated, a portable parts washer for washing product parts prior to assembly of a product includes a washer tank having an entrance, an exit, and a liquid nozzle. A conveyor carries the part through the washer tank. A tank of water, in communication with the washer tank, provides water used to clean the part. The water tank is connected to nozzles in the washer tank to spray the part. The nozzles are arranged circumferentially around the washer tank to spray the part from a plurality of directions. The conveyor has apertures so that water may pass through the conveyor to clean the parts. Preferably, the conveyor is made up of spaced gear belts which contact the part only along a small portion thereof. The belts do not obstruct the part and allow water to be sprayed over substantially the whole part. A drier is also provided to dry the parts after they are cleaned.

DESCRIPTION OF THE PREFERRED EMBODIMENT

Figure 1:
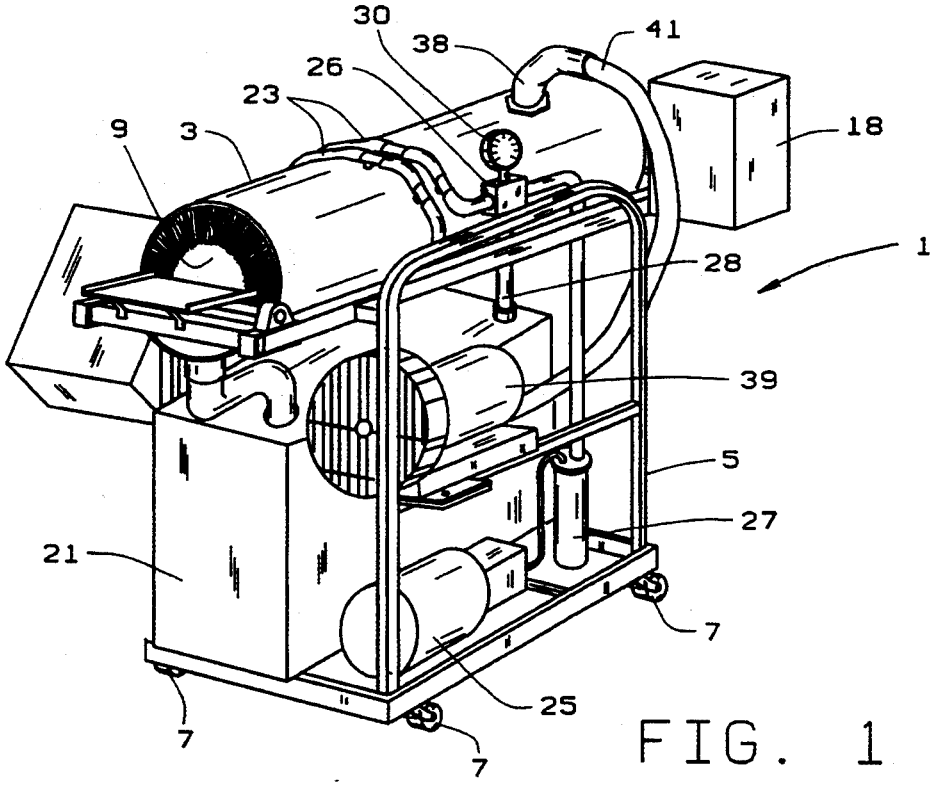
FIG. 1 is a perspective view a right side and entrance of an illustrative embodiment of a parts washer of the present invention.
Figure 2:
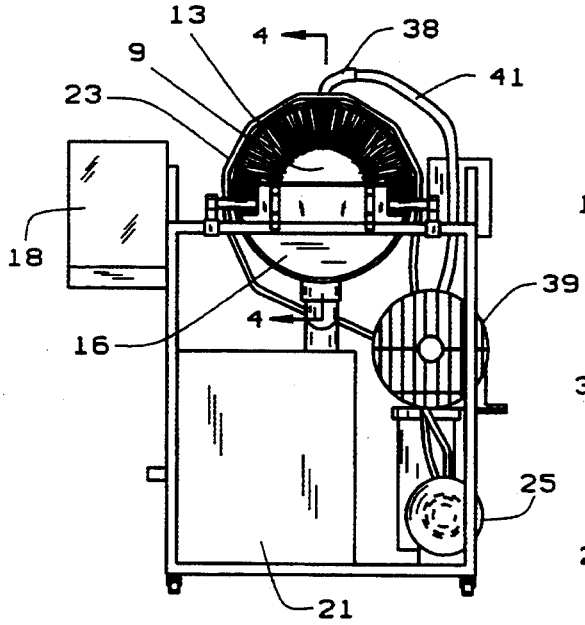
FIG. 2 is a front elevational view of the washer.
Figure 3:
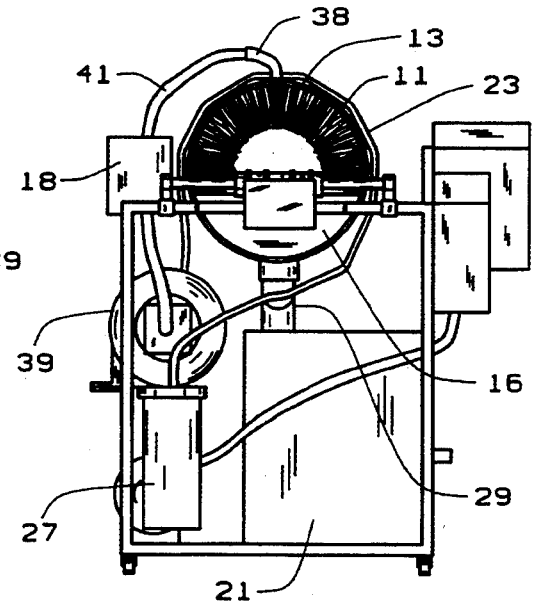
FIG. 3 is a rear elevational view of the washer.
Figure 4:
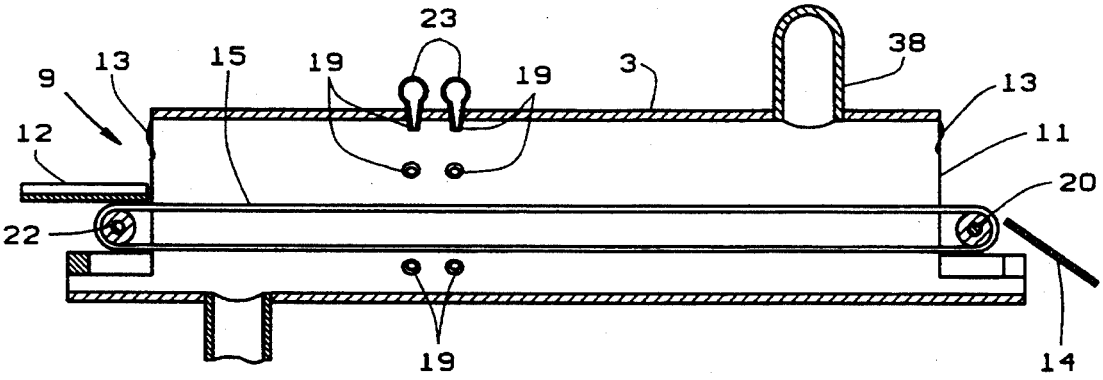
FIG. 4 is a cross-sectional view, partly broken away, of the washer tank of the washer.
Figure 5:
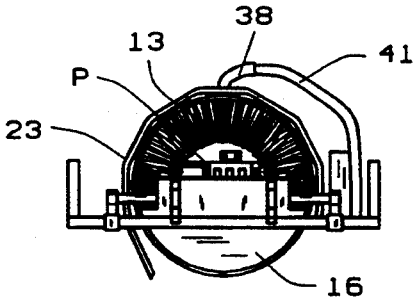
FIG. 5 is a front end view of the washer tank, partly broken away, with a part being introduced into the washer for washing.
Figure 6:
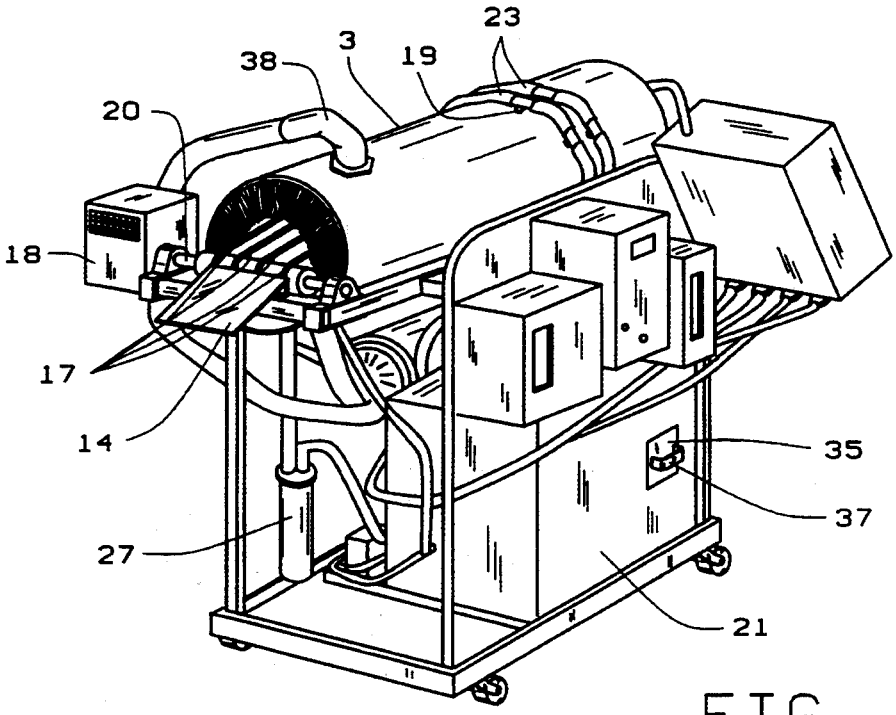
FIG. 6 is a perspective view of the left side and exit end of the washer tank.
Figure 7:
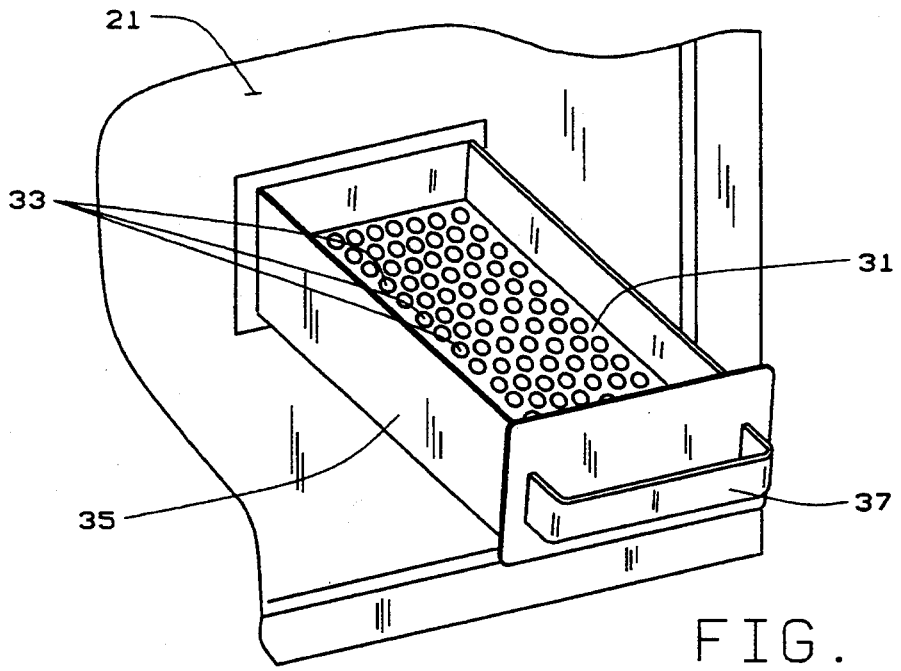
FIG. 7 is an enlarged sectional view of the water tank showing a catch pan of the washer for catching metal chips.

Referring to the figures, one illustrative embodiment of a parts washer of the present invention is generally show by reference numeral 1. Washer 1 washes parts P which are cast, molded, machined, etc. by spraying a pressurized spray of water at a part placed in the washer. This removes oil, grease, metal shavings, etc. from the part so that it may then be used to produce a final product. Washer 1 includes a washing tank 3 mounted on a frame 5. Frame 5 includes caster wheels 7 so that washer 1 will be portable.

Washing tank 3 is preferably made from a pipe, such as a five foot long, one foot inner diameter PVC pipe. This size is small enough that the washer is easily portable, yet large enough to thoroughly wash machined, cast, or molded parts for assembly into a final product. Other sizes of washers could of course be used to accommodate different sized parts. Tank 3 has an inlet 9 and an outlet 11. Brushes 13 radiate inwardly from the edge of the inlet and outlet to prevent water from exiting tank 3. Shelves 12 and 14 are provided at the inlet and outlet, respectively. Parts P maybe placed on the shelf 12 for introduction into tank 3 and urged onto shelf 14 when exiting tank 3 for collection of the cleaned part. Brushes 13 are positioned above shelves 12 and 14. Tank 3 is closed below the shelves by a cover 16 which may be made of any desired material, such as Lexan. The connection of the cover 16 and tank 3 is sealed to prevent water from escaping from tank 3.

A conveyor 15 carries the parts to be washed through the tank. Conveyor 15 is preferably comprised of four narrow gear belts 17 which are evenly spaced apart. The use of spaced gear belts 17 allows water to reach the part from all sides, as will be explained below. Conveyor 15 is driven by a motor 18. Motor 18 is operatively connected to, and drives, a roller 20 located at the exit 11 of washer 1. Conveyor 15 is a continuous conveyor and is wraps around roller 20 and a roller 22 at the entrance 9 of washer 1. Conveyor 15 frictionally engages roller 20 to be driven thereby. Because conveyor 15 is continuous, parts may be washed on a continuous basis.

A plurality of nozzles 19 are positioned near the washer inlet 9. Nozzles 19 are preferably evenly spaced around the circumference of the tank 3 and preferably in more than one row. Two rows of nozzles 19 are shown in the drawings and each row of nozzles preferably has six nozzles. Nozzles 19 are connected to a water reservoir 21 by hoses 23. Water is pumped through nozzles 19 and into tank 3 by a pump 25. Pump 25 is preferably a three-stage high pressure pump. A filter 27 is placed in line 23 between pump 25 and nozzles 19. Filter 27 is preferably a cartridge filter which removes dirt, grease, oil etc. from the water before the water is used to clean the parts. A valve 26 between pump 25 and nozzles 19 allow for the water pressure to be adjusted. The valve 26 is preferably positioned between filter 27 and nozzles 19. Valve 26 is preferably part of a T-junction which has a return hose 28 which directs water which does not pass through to the nozzles back to the liquid tank 21. A gauge 30 is also connected to the T-junction so that the water pressure may be determined. Thus, an operator may observe the gauge to change the fluid flow to a desired pressure. The parts that are in the tank 3 inside of the circle defined by the nozzles are showered with a jet of pressurized water to clean the part. Because the conveyor 15 is made of spaced gear belts, water can reach the part from all sides to thoroughly clean the part.

The water that is used to clean the parts, falls by gravity, back to water tank 21 along a pipe or hose 29. This return water carries with it metal chips and shavings. It is therefore passed through a catch pan 31 which removes the metal chips from the water stream. The bottom of catch pan 31 has a plurality of perforations 33 sized to catch small metal shavings, but to allow water to pass therethrough. Catch pan 31 is contained in a removable drawer 35 which has a handle 37 attached thereto. Catch pan 31 may thus be removed so that the metal chips removed from the return water may be removed from the catch pan. The water which passes through the catch pan joins the main water supply so that it may again be used to clean parts, to a water filter 27 through a hose 29.

Figure 8:
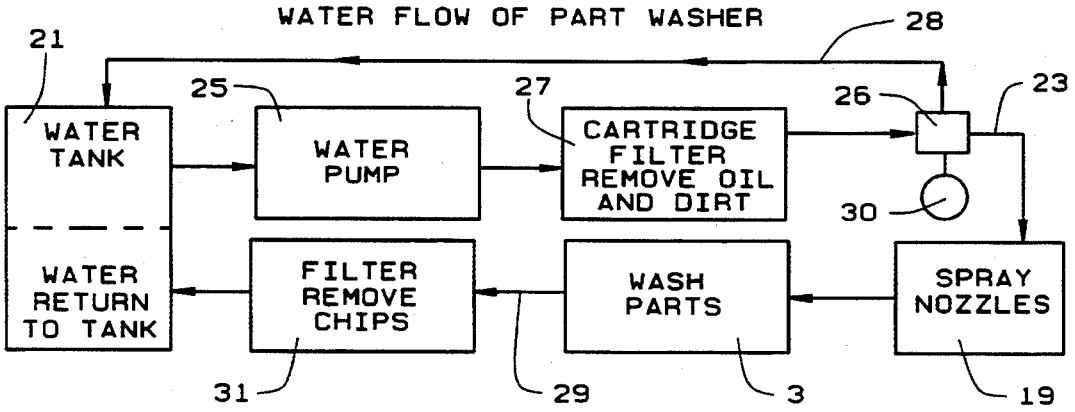
FIG. 8 is a flow chart of the path water takes through the washer.
Figure 9:
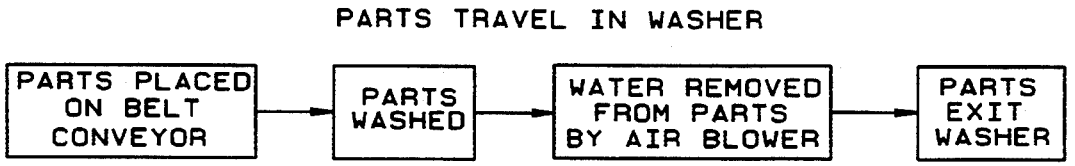
FIG. 9 is a flow chart of the path of a part through the washer.

As can be seen, the water path is self-contained in washer 1. New water need not be continuously added to the washer, nor need water be continuously drained from the washer. As shown best in FIG. 8, the water is drawn from water tank 21 by pump 25 and through hoses 23 to filter 27 and then nozzles 19 to clean the parts on the conveyor in washer tank 3. The water than returns to tank 21 via line 29. In tank 21, the return water is passed through catch pan or filter 31 before the return water joins the water supply. Although water need not be added to, or drained from, tank 21 on a continuous basis, it is desirable that the water be drained from the tank and that it be filled with fresh water on a periodic basis. Therefore, a drain and a fill connection are provided in tank 21.

The use of filter 27 and catch pan 31 allow the water to be recycled. Catch pan 21 removes metal shavings and chips from the return water and filter 27 removes dirt, grease, oil, etc. from the water. The water is thus cleaned prior to being sprayed on the parts to be cleaned.

A drier 38 is positioned in tank 3 after nozzles 19 and near outlet 11 to dry the parts prior to exiting the washer 1. Drier 38 preferably consists of a blower 39 which blows air through a duct 41. Duct 41 is connected to washer tank 3 to introduce air thereinto to remove water from the washed part and to at least partly dry the part.

As can be appreciated, washer 1 is a portable washer which recycles the water with which it is initially charged. It thus requires no water to be continually fed into it or to be drained therefrom. All it needs is a power source to operate the blower, water pump, and conveyor motor. It may therefore be moved from one part forming station to another, when needed to clean parts as they are produced. The parts are cleaned by washer 1 and dried to provide a part which may be nearly immediately used. This machine can thus eliminate the need to transport the part to be cleaned to one specific cleaning station. It thus reduces the travel that a part must go through before it is finally sent to its place in a production line. Because the part can be used so soon after cleaning, and because its travel is reduced, machine 1 can be used to reduce the parts-in-progress inventory.

The foregoing description is set forth for illustrative purposes only. Numerous variations, within the scope of the claims, may be apparent to those skilled in the art. For example, conveyor 15 may be made from a highly porous web or other construction which will freely allow water to pass therethrough, rather than spaced gear belts 17. If water tank 21 is large enough and the water is contained for a sufficiently long time in tank 21, the metal chips may be allowed to settle out of the water, thereby obviating the need for catch pan 31. However, the chips would have to be cleaned from the tank on a periodic basis. These variations are merely illustrative.

I claim:

1. A portable parts washer for washing product parts prior to assembly of said product, said washer comprising:

a washer tank having an entrance, an exit, and a plurality of liquid serially connected nozzles arranged circumferentially around said washer tank in at least two rows to spray said parts from a plurality of directions, each row including at least three nozzles, the nozzles of each row being connected in series by a length of tubing external of said washer tank, said nozzles consisting of a generally T-shaped body including a cross member which is connected to said length of tubing and a radial portion which extends through said washer tank to define a spray end of said nozzle;

a conveyor for carrying said parts through said washer tank, said conveyor comprising at least two spaced belts which contact said parts only along a small portion of said parts such that a maximum amount of surface area of said parts are exposed to spray from said nozzles;

brushes positioned at said washer tank entrance and exit, said brushes extending radially inwardly of said washing tank from edges of said entrance and exit , said brushes having a radially inner end, the radially inner ends of said brushes defining an arc spaced from said conveyor;

a tank of fluid in communication with said washer tank, said fluid tank being defined by externally exposed walls and being connected to said nozzles to spray said parts with fluid;

a liquid recycling system in communication with said washer tank and said tank of fluid, said liquid recycling system including a liquid filtering system having a filter for removing oil and dirt from said liquid and an externally accessible catch pan for removing metal pieces from said liquid, said catch pan being contained in a removable drawer which extends through one of said fluid tank walls so that said catch pan can be removed for cleaning of said catch pan; and a drier to dry said parts.

2. The portable parts washer of claim 1 including an external handle on said drawer, said handle being grabable to remove said catch pan from said washer.

3. The portable parts washer of claim 2 wherein said drier includes a blower.

4. The portable parts washer of claim 3 wherein said blower is positioned adjacent said washer tank exit.

5. The portable parts washer of claim 1 wherein said conveyor belts comprise gear belts.

6. A portable parts washer for washing parts on a continuous basis comprising:

a support stand having a plurality of wheels associated therewith for providing portability and movability of said stand;

a washing tank mounted on said stand, said washing tank including an entrance and an exit, the entrance and exit being partially closed to prevent fluid from exiting said washer tank;

a conveyor system mounted on said stand in association with said washing tank to convey parts through said washing tank:

means mounted on said stand for driving said conveyor;

a fluid supply container mounted on said stand:

a plurality of spray nozzles mounted to said washer tank for completely washing parts traveling therethrough;

means for connecting said nozzles to said fluid supply container;

drain means associated with said washer tank operatively connected between said washer tank and said fluid container to return used washing fluid to said container, said fluid returning to said fluid container by gravity flow:

a filter system for providing filtered fluid to said spray nozzles, the filter system including a removable catch pan mounted in a drawer slidably received in said fluid supply container, said drawer having an external handle for removing said drawer from said washer;

a drier mounted in association with said washing tank for drying parts upon egress from said washing tank; and brushes positioned at said washer tank entrance and exit which partially close said washing tank, said brushes extending radially inwardly of said washing tank from edges of said entrance and exit, said brushes having a radially inner end, the radially inner ends of said brushes being spaced from said conveyor.

7. The portable parts washer of claim 6 wherein said filtering system further includes a filter for removing dirt, grease, and oil from said fluid prior to fluid passage through said nozzles.

8. The portable parts washer of claim 1 wherein the washer tank is generally cylindrical.

* * * * *